United States Patent [19]

Gall

[11] 4,376,493

[45] Mar. 15, 1983

[54] LOCKABLE CLOSURE FOR CONTAINERS

[75] Inventor: John C. Gall, Chicago, Ill.

[73] Assignee: Sears, Roebuck and Co., Chicago, Ill.

[21] Appl. No.: 188,806

[22] Filed: Sep. 19, 1980

[51] Int. Cl.[3] ..... B65D 41/10; B65D 41/12; B65D 41/14

[52] U.S. Cl. ..... 220/307; 220/306; 220/309; 150/0.5; 215/272

[58] Field of Search ..... 220/306, 309; 150/0.5; 215/272

[56] References Cited

U.S. PATENT DOCUMENTS 3,589,551 6/1971 Hagglom ..... 220/309
3,688,942 9/1972 Mitchell et al. ..... 220/306

FOREIGN PATENT DOCUMENTS 197809 9/1978 France ..... 215/272

*Primary Examiner*—George T. Hall
*Attorney, Agent, or Firm*—Arnstein, Gluck & Lehr

[57] ABSTRACT

A lockable closure for a container having an annular lip advantageously has locking means whereby the closure can be releasably locked to the container. The closure has at least an annular portion adapted to be disposed in contact with a portion of the annular lip of the container, and preferably also an annular wall adapted to contact a portion of a wall of the container to provide a sealing engagement therewith. The locking means generally comprises shoulder means for lockingly engaging the annular lip of the container and bending means adjacent the shoulder means for deflecting the shoulder means about the annular lip of the container. The closure is useful with containers formed of various materials, for example, of both metal and molded plastic.

12 Claims, 11 Drawing Figures

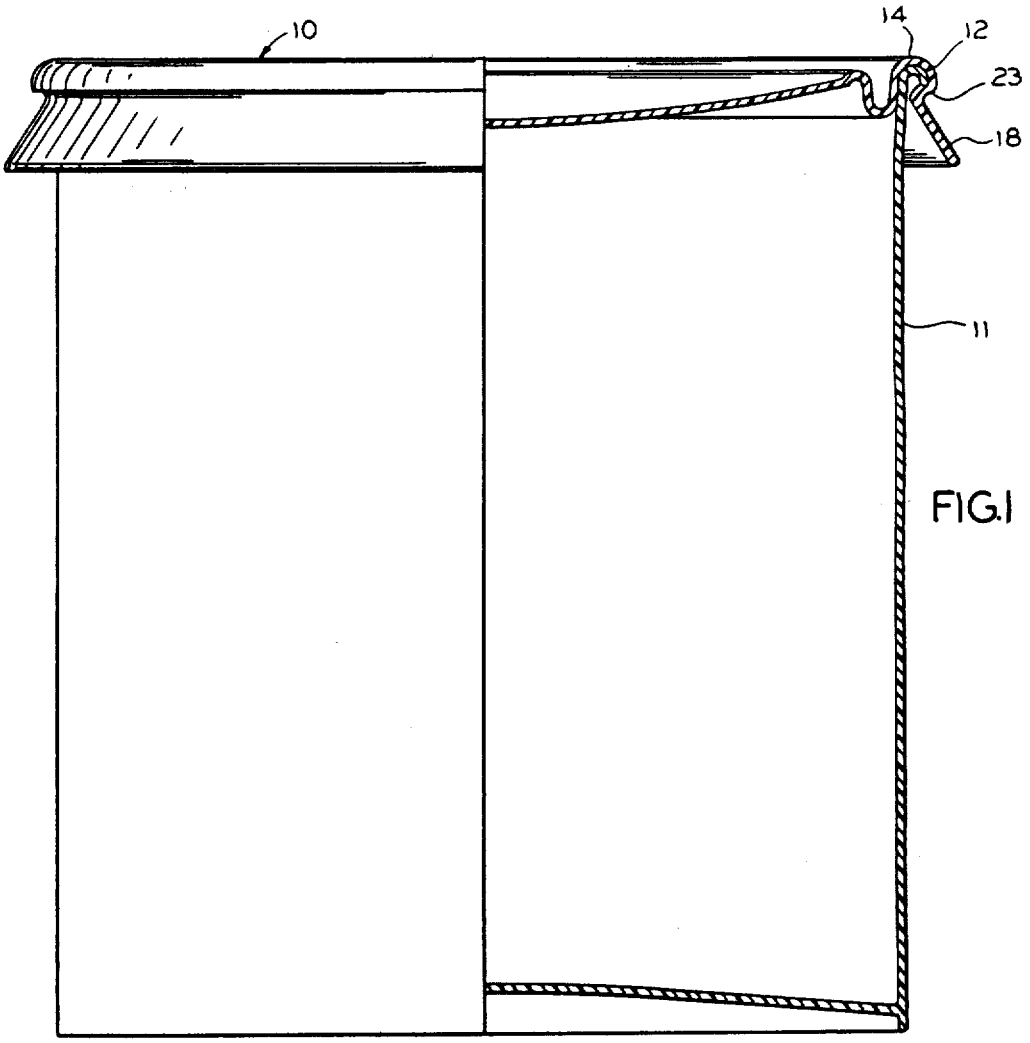
FIG.1
FIG.2
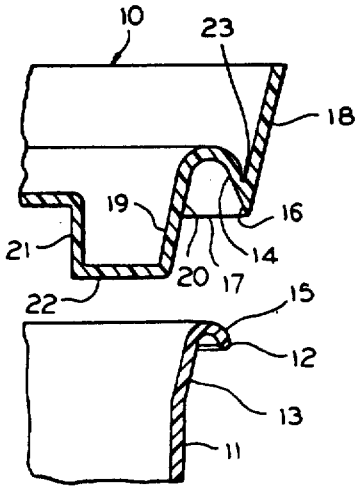
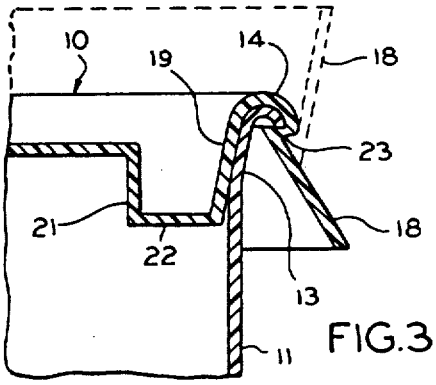
FIG.3

LOCKABLE CLOSURE FOR CONTAINERS

FIELD OF THE INVENTION

This invention relates to a closure for a container, and, more particularly, to a lockable closure, for example, a lid, which is releasably locked to a container having an annular lip.

BACKGROUND OF THE INVENTION

Container and closure combinations presently known to the art generally consist of injected molded containers and lids wherein one or more lips or edges are molded into one component while mating grooves are molded into the other component. Locking of the closure to the container is commonly provided by diametral sizing so that the marginal edge of the lid must be stretched during engagement and the components snap into locked position. In the common arrangement, the one or more lips or edges and mating grooves require a negative draft in at least one set of molds and therefore necessitates longer chill times in the molding operation so that the material can be deformed while withdrawing the component from the mold. The degree of negative draft required is directly related to the holding power of the closure, that is, the higher the degree of negative draft and the difficulty in removing the component from the mold, the greater the security of the locking arrangement. Further, the more secure the locking arrangement the more difficult it will be for a user to remove the closure from the container. The difficulty in removing the closure is often objectionable for applications where ease of removal of the closure without the use of tools, is desirable.

In the case of containers for paint and similar substances, cylindrical metal cans have been the industry standard. While closures for these cans have been successfully designed, and the combination of can and closure or lid passes various tests, particularly the shipping drop test, the use of metal cans are objectionable both because of relatively expensive materials used therein and the inability to conveniently nest empty containers for economical shipping and storage. Attempts have been made to utilize molded plastic containers for paint and similar substances, but closures designed for such containers generally do not provide for positive locking of the closure to the container, and specifically, the combination of closure and container does not pass the test requirements, particularly the shipping drop test.

Therefore, one object of the present invention is to provide a lockable closure for a container in which the closure can be brought into and out of locking engagement with the container.

Another object of the present invention is to provide a closure which is applicable to containers of various materials and construction which can be brought into and out of locking engagement with the container.

A further object of the invention is to provide a closure of simplified design producible by conventional molding methods with little or no negative draft, and which provides for locking of the closure to the container without supplemental locking means.

Still another object of the present invention is to provide a closure having means for sealing and locking the closure which are relatively independent of the material or construction of the container.

A further object of the invention is to provide a lockable closure having self-retaining locking means which retains its unlocked or locked condition, and can be conveniently locked and unlocked by the user.

These and other objects and advantages of the present invention will be readily apparent to those skilled in the art from the following description.

SUMMARY OF THE INVENTION

In general, the objects and purposes of the invention are met by providing a closure having at least an annular portion adapted to be disposed in contact with a portion of an annular lip of a container, with the closure having shoulder means for lockingly engaging the annular lip of the container. The shoulder means of the closure extends from the annular portion of the closure, and in one embodiment comprises individual shoulders extending from the annular portion of the closure, and in another embodiment preferably comprises an annular shoulder again extending from the annular portion of the closure. The closure further includes deflectable bending means adjacent the shoulder means for deflecting the shoulder means about the annular lip of the container. In one embodiment the bending means is an annular wall extending from the shoulder means which may be of uniform thickness, and further may terminate in an annular portion of increased thickness with respect to the thickness of the remainder of the wall. In another embodiment, the bending means comprises a plurality of spokes or ribs extending from the shoulder means, whereby upon the deflection of the ribs the shoulder means adjacent thereto is pivoted about the annular lip of the container into and out of locking engagement with the lip of the container. The plurality of ribs in the last-described embodiment may integrally terminate in an annular ring of increased thickness with respect to the ribs to facilitate deflection of the ribs, and hence, the pivoting of the shoulder means about the annular lip of the container into and out of engagement therewith.

The closure of the present invention preferably includes an annular wall positioned inwardly of the annular portion previously described with the annular wall having at least one portion which is adapted to contact a portion of a wall of the container to provide a sealing engagement with the container wall. The closure of the present invention preferably also includes an annular portion of less strength than the portion adapted to be disposed in contact with the annular lip of the container, with the annular portion of less strength being positioned adjacent the shoulder means, whereby upon deflection of the bending means, the shoulder means pivots about the portion of less strength into and out of locking engagement with the annular lip of the container.

The lockable closure of the present invention can be utilized with containers manufactured of various materials and construction, for example metal cans, plastic containers, and the like. The container must have an annular lip about the opening to be closed by the closure of the present invention, but otherwise the shape and construction of the container is not of concern to the present invention. Preferably the container includes a tapered annular wall adjacent the annular lip against which a wall of the closure may be placed in sealing contact. The closure of the present invention is particularly useful with plastic containers, for example, plastic paint pails having an annular lip.

The lockable closure of the present invention is preferably manufactured of resilient material to form a pliable closure, which may also be referred to as a lid. More preferably the closure is prepared by injection molding of a pliable plastic material, such as polypropylene or polyethylene or similar plastic materials and mixtures of such materials. Closures of the present invention constructed of the described materials are relatively pliable and can be placed over and/or into the opening of the container with a portion of the closure in contact with the lip of the container. In such position, the bending means of the closure is generally upturned and at zero stress. Upon applying a downward force to the bending means, the bending means will be deflected downwardly and outwardly causing the shoulder means positioned beneath the bending means to pivot about and into locking engagement with the annular lip of the container. As the deflecting force is applied to the bending means, the bending means and adjacent shoulder means of the closure are placed under stress and are forced toward the annular lip of the container. The continuation of the application of the deflecting force to the bending means causes the bending means to assume a downwardly position where the bending means is no longer under stress and the locking condition of the shoulder means to the annular lip is retained until a external deflecting force is applied to the bending means in an opposite, upward direction. The operation and construction of the closure of the present invention will be further understood from the following description of the drawings and preferred embodiments.

BRIEF DESCRIPTION OF THE DRAWINGS

In the drawings:

FIG. 1 is an elevational view, partly in section, of a closure in accordance with the present invention applied to a container with the closure in a locked condition.

FIG. 2 is a fragmentary, exploded, sectional view of the closure and container illustrated in FIG. 1 with the closure in its unlocked condition.

FIG. 3 is a fragmentary, sectional view of the closure and container illustrated in FIGS. 1 and 2 showing the closure in its locked condition with the unlocked condition of the closure being shown in broken lines.

DETAILED DESCRIPTION

Figure 4:
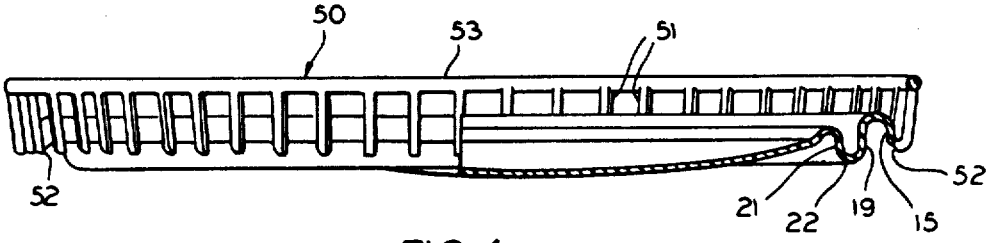
FIG. 4 is an elevational view, partially in section, of another embodiment of the closure of the present invention.

Referring to the drawings, the reference numeral 10 generally indicates a closure or lid in accordance with the present invention. Closure 10 is intended for use in closing and locking to a container 11 having a wall with a radially displaced downwardly extending annular lip 12. Container 11 can be formed of various materials, including metal or plastic, as shown, and may be cylindrical or have a tapered side wall to facilitate nesting of a plurality of empty containers. In addition, container 11 may have a recessed bottom, as shown, to facilitate stacking of containers which have been closed and locked by closures 10 of the present invention. In addition, container 11 preferably includes a tapered annular upper wall portion 13 (as best shown in FIG. 2), with the annular lip 12 extending therefrom.

Closure 10 has an annular portion 14 adapted to be disposed in contact with a portion 15 of the annular lip 12 of container 11. Closure 10 further includes shoulder means extending from annular portion 14 for lockingly engaging annular lip 12 of container 11. In the embodiment shown in FIGS. 1–3, the shoulder means extending from annular portion 14 is an annular shoulder 16 which is adapted to pivot about the end of annular lip 12 of container 11 into locking engagement therewith. Shoulder 16 is illustrated as forming an annular edge 17, although other configurations, such as a flat or rounded surface in cross section can be utilized.

Closure 10 further includes deflectable bending means adjacent the shoulder means for deflecting the shoulder means about annular lip 12 of container 11. In the embodiment shown in FIGS. 1–3, the bending means comprises an annular wall 18 extending from shoulder 16. Annular wall 18 may be of uniform thickness and may be relatively rigid or pliable with respect to the remainder of closure 10.

Closure 10 preferably includes an annular wall 19, positioned inwardly of annular portion 14 and having at least one portion 20 which is adapted to contact a portion of wall 13 upon annular portion 14 of closure 10 being placed into contact with portion 15 of lip 12. Upon contact of both annular portion 14 and portion 20 of wall 19 of closure 10 with lip 12 and tapered wall 13 of container 11, respectively, at least two areas of sealing between closure 10 and container 11 are established, as best shown in FIG. 3. Wall 19 can be tapered and can be a part of an annular well formed by a second wall 21 and a bottom 22.

Furthermore, in the embodiment shown in FIGS. 1–3, closure 10 includes an annular portion 23 of less strength than portion 14 which is positioned adjacent the shoulder means, in this embodiment shoulder 16. Portion 23 may have less strength than portion 14 by having a narrower cross-section than portion 14. Annular portion 23, having less strength than portion 14, serves as an area of pivoting of the shoulder means as the latter is placed into and out of locking engagement with annular lip 12 of container 11 upon deflection of the bending means, e.g. wall 18, between its upwardly and downwardly positions.

Figure 9:
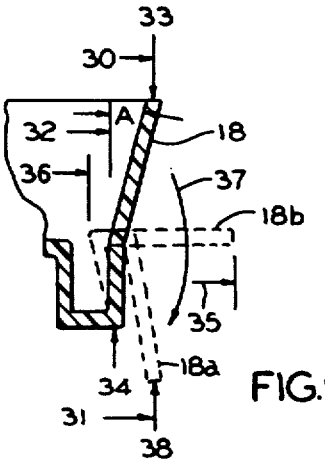
FIG. 9 is a fragmentary sectional view of the closure of FIG. 8 illustrating the forces and deflection of the closure of the present invention in being placed from an unlocked to a locked condition.
Figure 10:
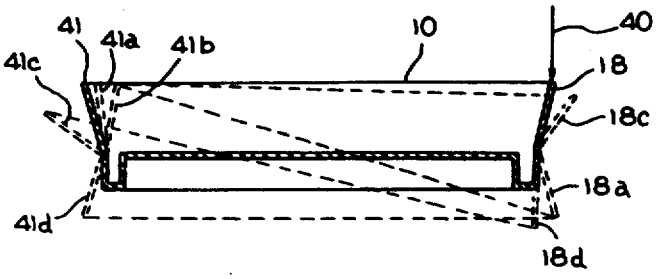
FIG. 10 is an elevational view of the simplified closure shown in FIG. 8 showing the deflection of the closure in broken lines in being placed from an unlocked to a locked condition.

Reference is made to FIGS. 8–11 and also FIGS. 1–3, reference numerals in the latter being utilized in the simplified views of the former to describe similar elements, for the purpose of illustrating the principle of operation of the closure of the present invention. To close and secure an opening in a container 11, closure 10 is placed over and into the opening with annular portion 14 of closure 10 in contact with portion 15 of lip 12 of the container, and with portion 20 of wall 19 in contact with tapered wall 13 of the container. Assuming that FIGS. 9 and 10 represent a portion of the annular wall 18 of closure 10, arrow 30 indicates the position (diameter if FIG. 9 was drawn in full as in FIG. 10) of the edge of wall 18 (the bending means) at its upper, unstressed, unlocked position. Arrow 31 indicates the position (similarly the diameter) of the edge of wall 18 at its lower, unstressed, locked position with the wall being shown in broken lines and designated by numeral 18*a*. Arrow 32 indicates the position (again similarly the diameter) of the lower limit of wall 18, i.e. at its junction with the shoulder means upon wall 18 being at its upper, unstressed, unlocked position.

Upon application of a force to the edge of wall 18 as indicated by arrow 33, with a reaction indicated by arrow 34, as the force applied at 33 increases, wall 18 will deflect downwardly and outwardly approaching the position indicated as 18*b*. During the application of force at 33, the upper portion of wall 18 is subjected to increased internal tension due to the increase in the diameter of wall 18 from the position indicated by arrow 30 to the position indicated by arrow 35. As the material of closure 10 is resilient, the lower or inner limit of wall 18 is forced into compression and tends to reduce in the diameter thereof from the position indicated by arrow 32 to the position indicated by arrow 36.

Continued downward application of force as indicated by arrow 33 to the edge of wall 18 beyond its position indicated as 18*b*, results in further movement of wall 18 along path 37 to a final, locked position indicated at 18*a*. At this position the edge of wall 18 will be at the position indicated by arrow 31, at which the edge of wall 18 has the same diameter as the original diameter indicated by arrow 30, and wall 18 is unstressed with its lower limit again at a position or diameter indicated by arrow 32. At this position, there is essentially zero tension, i.e. no stress, on wall 18 which would tend to cause the bending means, i.e. wall 18, to return to its unlocked position. It will be understood that the maximum stress conditions are reached when wall 18 is in position 18*b*, which position provides self-energized stress relief, conveniently termed snap action, by movement upwardly or downwardly along path 37 from position 18*b*.

In order to unlock the closure from the container, a force is applied to wall 18, which is now in position 18*a*, in the direction indicated by arrow 38 to again cause wall 18 to be stressed and to be moved through position 18*b* and deflected so that its lower or inner limit (diameter) is deflected from position 32 to position 36. The deflection continues until wall 18 reaches the position indicated by the numeral 18 in FIG. 9, and the lower or inner limit of wall 18 again reaches the position or diameter indicated by numeral 32. As shown in FIG. 9, the force applied at 33 or 38 is a maximum at the zero stress condition, i.e. when wall 18 is as shown in FIG. 9 or at position 18*a*; and the applied force is at a minimum when wall 18 is at position 18*b*. The magnitude of the forces are thus a function of the angle between the position of the wall and the vertical, as indicated in FIG. 9 by the letter A.

FIG. 10 further illustrates the operation of the closure of embodiments FIGS. 1–3 in full circular condition. Upon the application of a single peripheral force to wall 18 in the direction and at the point indicated by arrow 40, the portion of wall 18 beneath arrow 40 is moved outwardly towards the position indicated by numeral 18*c*. In the movement of wall 18 to position 18*c*, the diametrically opposed portion of wall 18, indicated by numeral 41 for convenience, is drawn inwardly to a position, which for the sake of illustration is indicated by numeral 41*a*. Concurrently, all circumferential points of wall 18 will be drawn inwardly in some degree resulting in an ovate shape of the outer edge of wall 18. The described movement reduces the force required to achieve the over center or unstressed condition of wall 18 indicated by position 18*a*. Portion 41 will be in position 41*b* at this time. The transfer of the force from the position indicated by arrow 40 to portion 41 at 41*b* to move the same to position 41*c*, then draws wall 18 from position 18*a* to position 18*d*. The ovate condition of the edge of wall 18 is similarly increased so that portion 41 at position 41*c* can be brought over center to position 41*d* where the angular relationship of all circumferential points will be equal and at zero or minimal internal stress, as illustrated by positions 18*a* and 41*d*. Thus, it can be seen that a single movable force first applied at and in the direction indicated by arrow 40 for causing the closing and locking operation of the closure will be considerably less than a force applied to the entire periphery of wall 18. Similarly, a lesser single movable force need be applied to unlock the closure than an unlocking force applied to the entire periphery of wall 18.

Figure 11:
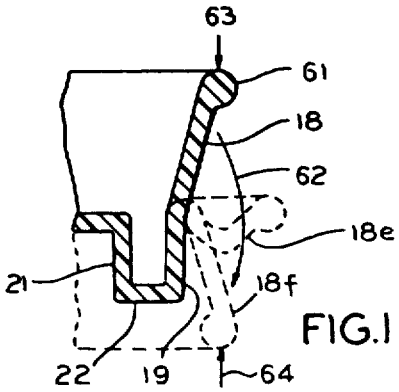
FIG. 11 is a fragmentary, sectional view of a simplified closure in accordance with another embodiment of the invention showing the locked and an intermediate position of the closure in broken lines.

The same principle of operation is applicable where the upper portion of wall 18 is reinforced to reduce tensional deformation, as by a lip or ring portion of increased thickness with respect to the remainder of wall 18. FIG. 11 illustrates the principle where, for illustration purposes, wall 18 integrally terminates in annular portion 61 of increased thickness. Wall 18 and portion 61 will deflect along path 62 upon the application of a force in the direction and at the point indicated by arrow 63. As wall 18 is resilient, wall 18 is deflected to a greater degree than annular portion 61 due to the latter's increased thickness and resultant resistance to deflection, causing a bend in wall 18 as shown by position 18*e*. Furthermore, due to the combination of resilient wall 18 and less resilient or less stretchable portion 61, wall 18 will follow path 62 upon the continued application of force initially applied as indicated at 63 to provide a spring-like, or snap action which will serve to force wall 18 into the position indicated as 18*f*. Wall 18 is retained in the latter position by the minimizing stress characteristics of annular portion 61, maintaining the closure in a securely locked condition until a releasing force is applied to wall 18 in the direction indicated by arrow 64.

Figure 5:
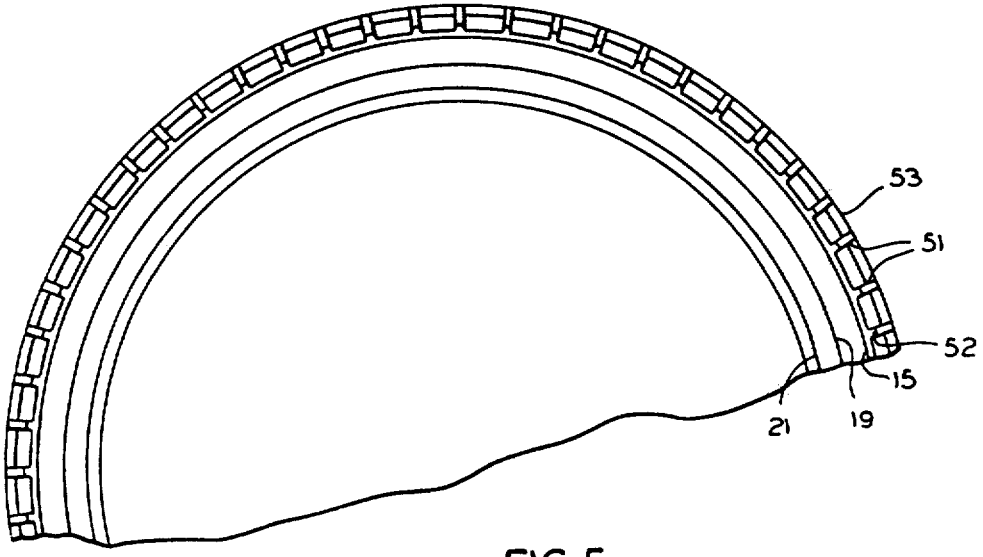
FIG. 5 is a fragmentary bottom view of the closure shown in FIG. 4.

In another embodiment of the present invention, as shown in FIGS. 4 and 5, wherein elements similar to elements in the embodiment illustrated in FIGS. 1–3 are indicated by the same numerals, closure 50 has as its bending means a plurality of ribs 51 extending from the shoulder means, which in the illustrated embodiment is a plurality of individual shoulders 52, each extending from annular portion 15 of closure 50 and from which extend one of the plurality of ribs 51, but can also be a web as in FIGS. 1–3. Upon the deflection of ribs 51, individual shoulders 52 are pivoted about annular lip 12 of a container 11 (FIGS. 1–3) into and out of locking engagement therewith. The plurality of the ribs 51 integrally terminate in an annular ring 53 of increased thickness with respect to ribs 51. Annular ring 53 will assume an ovate condition upon the application of locking or unlocking force to a single point or a small portion along the periphery of ring 53, in a manner similar to that described in connection with FIGS. 8–11. Closure 50 can include an annular portion 23 of less strength to serve as a hinge or pivot point as in the first embodiment, for the deflection of shoulders 52 about a lip 12 of a container 11.

Figure 6:
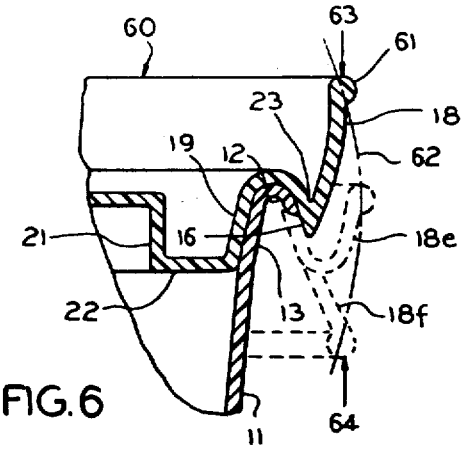
FIG. 6 is a fragmentary, sectional view of still another embodiment of the closure of the present invention shown in unlocked condition with a container, with the locked condition and an intermediate condition of the closure being shown in broken line.

FIG. 6 illustrates still another embodiment of the present invention wherein elements similar to elements in the embodiment shown in FIGS. 1–3 are indicated by the same reference numerals, and need not be further described. Referring to FIG. 6, closure 60 has an annular wall 18 which is substantially of uniform thickness, or can have a thickness which increases progressively away from shoulder 16. Wall 18 integrally terminates in an annular portion 61 of increased thickness with respect to the thickness of the remainder of wall 18. Wall 18 and portion 61 will deflect axially along path 62 through the positions indicated in broken line upon the application of a force in the direction and at the point indicated by arrows 63 or 64, as heretofore described in connection with FIG. 11. Wall 18 is retained in the position indicated as 18*f* with shoulder 16 pivoted about and locked to lip 12 by the minimizing stress characteristics of annular portion 61, maintaining closure 60 in a securely locked condition until a releasing force is applied to wall 18 in the direction indicated by arrow 64.

Figure 7:
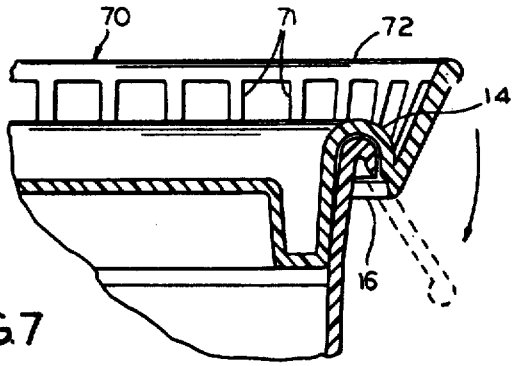
FIG. 7 is a view similar to FIG. 6 showing still another embodiment of the present invention.
Figure 8:
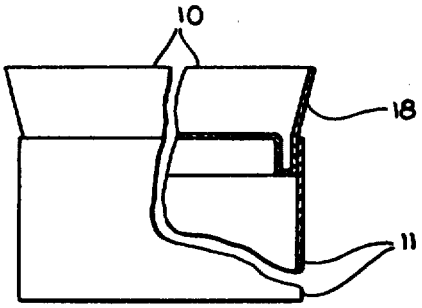
FIG. 8 is a simplified, fragmentary, partially sectional view of a closure of the present invention and a container for the purpose of illustration.

FIG. 7 illustrates another embodiment of the present invention wherein elements similar to elements illustrated in FIGS. 4 and 5 are referred to by the same reference numerals. In this embodiment, closure 70 includes as shoulder means an annular shoulder 16 extending from annular portion 14 as previously described in connection with FIGS. 1–3, but can also be a plurality of shoulders as in FIGS. 4 and 5. However, in this embodiment, the bending means comprise a plurality of ribs or spokes 71 which terminate integrally in an annular ring 72. Ribs or spokes 71 function as previously described in connection with the embodiment shown in FIGS. 4 and 5. Ring 72 in combination with ribs or spokes 71 provide an over center snap action as previously described.

It is seen from the foregoing that the closure of the present invention through its bending means, preferably in the form of an annular wall or a plurality of ribs or spokes, provides a mechanical leverage system which pivots shoulder means into and out of locking engagement with the lip of a container. In the locked or unlocked position, the closure is at a condition of zero internal stress, and hence is in a condition of maximum stability; whereas the closure is in a condition of maximum internal stress, and hence maximum instability, while the closure is being deflected from either its locked to its unlocked condition or from its unlocked to its locked condition. The closure provides an over-center snap action between the unlocked and locked conditions to facilitate locking and unlocking, and to retain the closure in either condition without the application of additional force or retaining means.

Various changes coming within the spirit of the invention may suggest themselves to those skilled in the art; hence the invention is not limited to the specific embodiments shown or described and uses mentioned, but the same is intended to be merely exemplary, the scope of the invention being limited only by the appended claims.

I claim:

1. A lockable closure for a container having a wall with a radially displaced downwardly extending annular lip, comprising:

an annular portion adapted to be disposed in contact with a portion of the annular lip of the container, shoulder means adapted to pivot about the extended end of the annular lip of the container, said shoulder means being integral with and extending from said annular portion of said closure, said shoulder means being movable into and out of engagement with the extended end of the annular lip of the container, and deflectable bending means integral with and extending from said shoulder means, said deflectable means cooperating with said shoulder means to provide a mechanical leverage system for pivoting said shoulder means about the extended end of the annular lip of the container, said mechanical leverage system being adapted to move said shoulder means into and out of engagement with the extended end of the annular lip of the container, said deflectable bending means including an annular continuous portion normally retaining said shoulder means in either an unstressed unlocked position out of engagement with the extended end of the annular lip of the container or a substantially unstressed locked position in engagement with the extended end of the annular lip of the container.

2. The lockable closure as defined in claim 1, wherein said closure includes an annular wall positioned inwardly of said annular portion, said annular wall having at least one portion which is adapted to contact a portion of the wall of the container in sealing engagement therewith.

3. The lockable closure as defined in claim 2, wherein said annular wall is normally tapered and is engageable with the wall of the container as said mechanical leverage system pivots said shoulder means about the extended end of the annular lip of the container.

4. The lockable closure as defined in claim 1, wherein said closure includes an annular portion of less strength than said portion adapted to be disposed in contact with the portion of the annular lip of the container, said annular portion of less strength being positioned adjacent said shoulder means, said shoulder means being adapted to pivot about the extended end of the annular lip of the container at said annular portion of less strength.

5. The lockable closure as defined in claim 1, wherein said deflectable bending means is an annular wall extending from said shoulder means, said annular wall comprising said annular continuous portion of said deflectable bending means.

6. The lockable closure as defined in claim 5, wherein said annular wall extending from said shoulder means is of uniform thickness.

7. The lockable closure as defined in claim 5, wherein said annular wall extending from said shoulder means terminates in an annular portion of increased thickness with respect to the thickness of the remainder of said annular wall.

8. A lockable closure for a container having an annular lip, comprising:

an annular portion adapted to be disposed in contact with a portion of the annular lip of the container, shoulder means for lockingly engaging the annular lip of the container, said shoulder means extending from said annular portion of said closure, and deflectable bending means including a plurality of ribs extending from said shoulder means, said deflectable bending means having an annular continuous portion for reversibly deflecting each of said ribs to thereby reversibly deflect said shoulder means adjacent thereto about the annular lip of the container into and out of locking engagement therewith, said annular continuous portion normally retaining said shoulder means in either a locked or an unlocked condition relative to the annular lip of the container.

9. The lockable closure as defined in claim 8, wherein ends of said plurality of ribs integrally terminate in an annular ring, said annular ring being of increased thickness with respect to said ribs, said annular ring comprising said annular continuous portion of said deflectable bending means.

10. The lockable closure as defined in claim 8, wherein said annular shoulder means comprises a plurality of individual shoulders, said shoulders each extending from said annular portion of said closure, said plurality of ribs including one rib extending from each of said plurality of individual shoulders.

11. The lockable closure as defined in claim 8, wherein said shoulder means comprises an annular shoulder, said shoulder extending from said annular portion of said closure, said plurality of ribs extending from said annular shoulder.

12. A lockable closure for a container having an annular lip, comprising a closure having an annular well adapted to be disposed within the area of the container defined by said annular lip, said well having an annular outer wall having at least one portion which is adapted to contact a portion of a wall of the container in sealing engagement therewith; said closure having an annular portion adjacent said outer wall adapted to be disposed in contact with a portion of the annular lip of the container when said portion of the outer wall is in contact with a portion of a wall of the container; said closure having an annular shoulder extending from said annular portion and an annular deflectable portion being bendable to pivot said shoulder about the annular lip of the container into and out of locking engagement therewith.

* * * * *